United States Patent [19]

Hentschel

[11] Patent Number: 4,613,258

[45] Date of Patent: Sep. 23, 1986

[54] APPARATUS FOR SETTING AND REMOVING TUNNEL CASING RINGS

[75] Inventor: Volker Hentschel, Dorsten-Wulfen, Fed. Rep. of Germany

[73] Assignee: Hochtief Aktiengesellschaft Vorm. Gebr. Helfmann, Essen, Fed. Rep. of Germany

[21] Appl. No.: 726,585

[22] Filed: Apr. 23, 1985

[30] Foreign Application Priority Data

May 11, 1984 [DE] Fed. Rep. of Germany ..... 3417524

[51] Int. Cl.[4] ..... E21D 11/40

[52] U.S. Cl. ..... 405/303; 405/146; 405/151

[58] Field of Search ..... 405/146, 150, 151, 138–141, 405/303; 299/31, 33

[56] References Cited

U.S. PATENT DOCUMENTS

| | | | |
|---|---|---|---|
| 3,266,257 | 8/1966 | Larrouze et al. | 405/146 X |
| 3,377,105 | 4/1968 | Wallers | 405/146 X |
| 3,382,002 | 5/1968 | Tabor | 299/31 X |
| 3,561,223 | 2/1971 | Tabor | 405/146 |
| 3,905,645 | 9/1975 | Bland | 299/33 X |

FOREIGN PATENT DOCUMENTS 8202276.3 6/1982 Fed. Rep. of Germany .

*Primary Examiner*—Dennis L. Taylor

*Attorney, Agent, or Firm*—Karl F. Ross; Herbert Dubno

[57] ABSTRACT

An apparatus for moving casing rings of an interior casing in tunnels, shafts and the like structures is disclosed. The apparatus includes a tubular support bridge structure arranged interiorly with respect to the inner casing, and a longitudinally movable transport carriage with carriage support ring which concentrically surrounds the support bridge structure. The apparatus also includes a segment support ring which carries adjustment manipulator assemblies for a respective casing ring. The segment support ring can be inclined with respect to the carriage support ring. A first intermediate support ring is mounted between the carriage support ring and the segment support ring. The connection for this includes cross guide assemblies and two pairs of control piston-cylinder assemblies. The control piston-cylinder assemblies serve to actuate the first intermediate support ring. A second intermediate support ring is generally arranged between the first intermediate support ring and the segment support ring, and in the first intermediate support ring in such a way that it can be rotated. The segment support ring can be connected to a respective second intermediate support ring by way of a fixed point and two pendulum piston-cylinder assemblies, whereby the latter are spaced from one another and from the fixed point by an equal distance. The apparatus is of simple configuration and affords a simpler hydraulic assembly than hitherto known.

9 Claims, 13 Drawing Figures

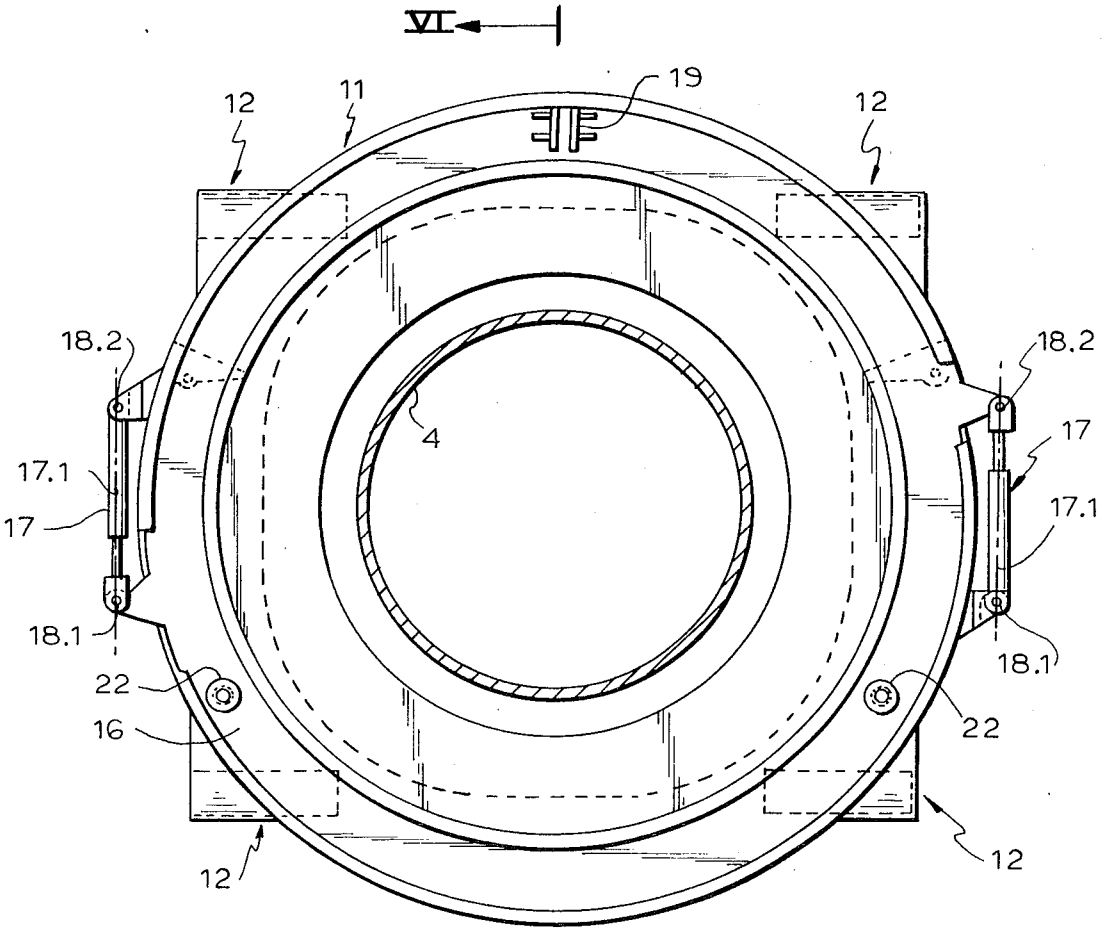
FIG. 5
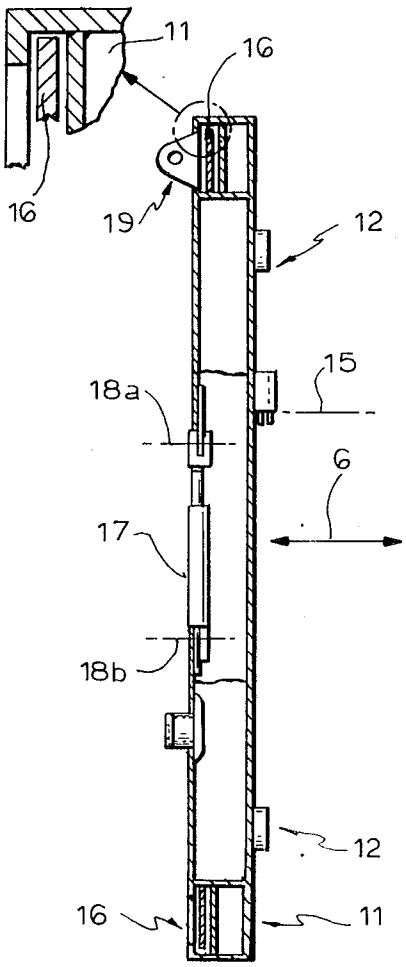
FIG. 6A
FIG. 6

APPARATUS FOR SETTING AND REMOVING TUNNEL CASING RINGS

CROSS REFERENCE TO RELATED APPLICATIONS

This application is related to my copending applications Ser. No. 690,163 filed Jan. 10, 1985, Ser. No. 673,775 filed Nov. 21, 1984 and Ser. No. 674,895, filed 11-26-84, to the commonly assigned copending application Ser. No. 697,785 filed Feb. 2, 1985 based upon German application Pat. No. 34 03 890.6 of Feb. 4, 1984.

FIELD OF THE INVENTION

My invention relates to apparatus for removing and/or installing casing rings in tunnels, shafts and the like structures. More particularly, the apparatus is intended for use in the construction of tunnels and the like structures with in-situ concrete emplacement methods.

BACKGROUND OF THE INVENTION

Tunnel casing rings usually comprise several individual casing segments or ring segments, and the casing rings, when positioned alongside each other, form an inner interior casing, duct, tube or similar protective circular structure. This structure lines the tunnel wall at a spacing therefrom in which concrete can be emplaced. The rings or casing sections are removed when the concrete has been set and the casing is no longer necessary.

An apparatus for installing and removing such rings can include a tubular support bridge structure and a transport carriage. The transport carriage is guided at the support bridge structure and can move or travel in longitudinal directions along the support bridge structure. The apparatus also can include a carriage or drive support ring on which are mounted the supporting framework or undercarriage for an operator station and associated drive means.

Furthermore, a segment support ring is arranged ahead of the drive support ring and parallel with respect to the latter. The segment support ring carries radial adjustment manipulator assemblies for the control of casing segments of a respective casing ring.

Two additional support rings can be provided of which the first one, also referred to as first intermediate support ring, is mounted between the carriage support ring and the segment support ring. The second support ring is arranged concentrically within the first support ring in such a way that it can turn or rotate in the first intermediate support ring.

The apparatus furthermore includes several piston-cylinder assemblies for actuating the first support ring, for moving the second support ring, and for inclining the segment support ring.

An apparatus of this type is described in German Utility Model (Gebrauchsmuster) No. 82 02 276. The inclining piston-cylinder assemblies in the apparatus of the German utility model are also arranged between the carriage support ring and the first intermediate support ring. The further support ring is identical with the segment support ring. Together with the first intermediate support ring, the segment support ring is of a construction equivalent to that of a sliding bearing, whereby the outer ring is provided by the segment support ring, and the inner ring is provided by the first intermediate support ring.

A disadvantage of this system is that the adjustability is limited and, control movements require complex hydraulic controls in order to alleviate kinematic incompatibilities.

OBJECTS OF THE INVENTION

It is therefore an object of the invention to provide an improved apparatus for moving casing rings which allows independent shifting or moving, as well as inclining, of the segment support ring with respect to the carriage support ring.

It is also an object of my invention to provide an apparatus whereby the respective spaces or compartments which receive adjusting or control components can be increased.

It is furthermore an object of the invention to avoid complex hydraulic control or actuating equipment.

It is also an object of the invention to reduce the number of hydraulic actuating units required.

It is furthermore an object of the present invention to provide an apparatus which is generally of simplified design but of improved versatility and adjustment or movement range.

SUMMARY OF THE INVENTION

These objects are attained in accordance with the invention in that a segment support ring and two pendulum piston-cylinder assemblies are connected to a second intermediate support ring which is adapted to act as a further support ring. The further or second support ring is generally arranged between the segment support ring and the first intermediate support ring. The connection includes means providing a fixed space-hinge point, or a similar device, allowing movement of said segment support ring, and two pendulum piston-cylinder assemblies. These piston-cylinder assemblies are equidistantly spaced from one another and from the fixed point, and the pendulum piston-cylinder assemblies are adapted to perform the function of respective inclining piston-cylinder assemblies. The term "space hinge" and terms of similar impact are intended to describe hinge joints having at least two degrees of pivotal freedom of movement, i.e. can pivot about at least two mutually perpendicular axes, and can be thought of as universal, cardan joints or ball joints.

The invention is based on the recognition that the separate execution of different adjustment or control movements leads overall to a considerable constructive simplification, even with a second intermediate support ring. This simplification is also applicable with respect to any respective inclination because use is made of only two hydraulic piston-cylinder assemblies, instead of the hitherto required four hydraulic piston-cylinder assemblies.

These hydraulic piston-cylinder assemblies are subjected to lower loads because the respective vertical forces emanating from the casing ring, which is supported by the segment support ring, are nearly fully transferred onto the second intermediate support ring by way of the means providing the fixed point.

In accordance with a preferred embodiment, the segment support ring is additionally connected to the second intermediate support ring at the side which is diametrically across from the mentioned fixed point, and the additional connection includes a rigid torque support with a rod member having an articular linkage at each end.

In accordance with a further preferred embodiment of the apparatus, the second intermediate support ring can be swung or rotated through an arc of 360° with respect to the first intermediate support ring.

Such embodiments contribute to a further load-reduction for the pendulum support, and to an increase of the range of twisting or turning movements about the longitudinal axis.

BRIEF DESCRIPTION OF THE DRAWING

The above and other objects, features and advantages will become more readily apparent from the following description, reference being made to the accompanying highly diagrammatic drawing, in which:

FIG. 5 is a cross section along line V—V in FIG. 1 showing details of the two intermediate support rings;

FIG. 6 is a cross section along line VI—VI in FIG. 5 through the intermediate support rings;

FIG. 6A is a detail of the peripheral arrangement of the two intermediate support rings within the circle in FIG. 6;

SPECIFIC DESCRIPTION

Figure 2:
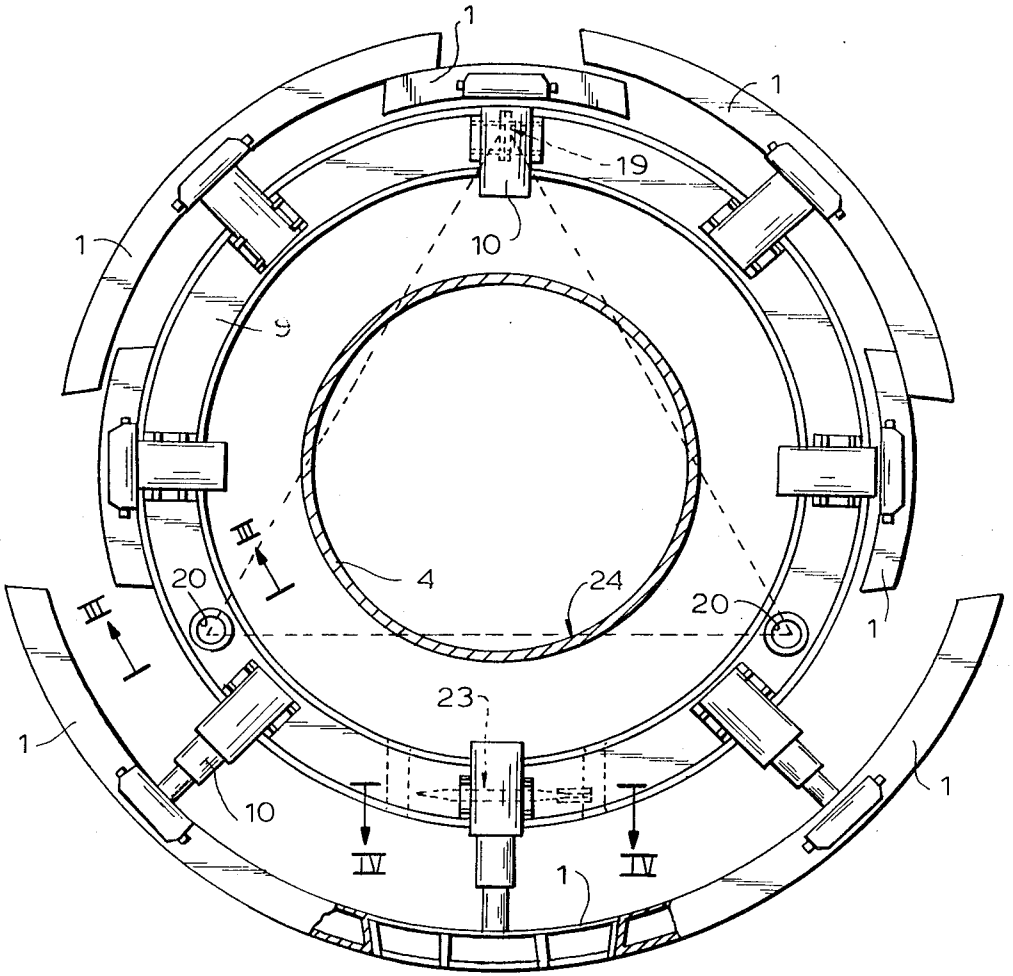
FIG. 2 is an end view in the direction of arrow II in FIG. 1.

The apparatus shown in the drawing serves for the installing, assembling, moving or relocating, and similar operations for casing rings 2 of an inner or interior casing 3 in tunnels, shafts and the like structures; especially in excavating, mining, construction, and the like operations. A typical casing ring 2 is comprised of several individual casing or ring segments 1. The casing rings 2, in turn, can be positioned alongside each other to form the interior casing 3, duct, tube or similar protective circular structure which facilitates working through the environment which needs to be penetrated.

The apparatus can be used in the construction of tunnels employing in-situ concrete construction methods, and the like construction procedures.

Figure 11:
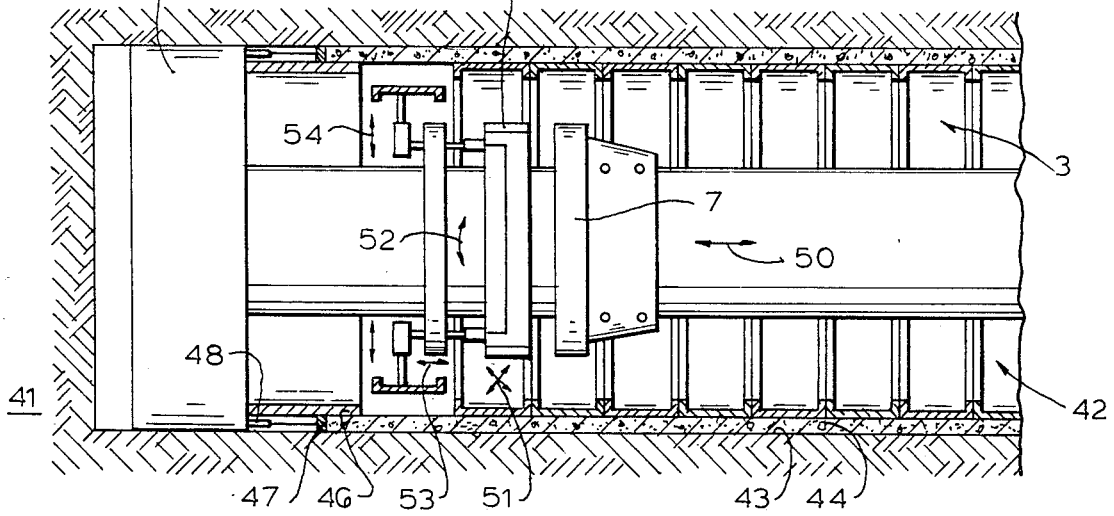
FIG. 11 is a diagram illustrating application of the apparatus of the invention.

More specifically, from FIG. 11 it will be apparent that a cutting head 40 can progressively advance through the subterranean rock structure 41 to form a tunnel or gallery 42 whose excavated wall 43 is lined with concrete 44. An apron 45 advances with the head 40 and defines a space 46 into which the concrete is pumped. A wall 47 can be retracted by piston and cylinder units 48 to permit continuous concrete pumping independently of the speed of excavation. The casing sections 2 are inserted and removed by the apparatus to be described.

The apparatus generally includes a tubular support bridge structure 4 (FIG. 1) which extends centrally within the inner casing 3 and can serve to conduct excavating or mining debris to the rear. A transport carriage 5 is guided at and on the support bridge structure 4, and the transport carriage 5 can move or travel to and fro in the longitudinal direction (arrow 6) with respect to the support bridge structure 4. Arrow 6 is positioned on or is coincidental with the longitudinal central axis of the apparatus.

The transport carriage 5 includes a carriage support ring 7 which carries the supporting framework or undercarriage 8 for an operator station 8.1 and associated drive means 8.2. The carriage support ring 7 concentrically surrounds the support bridge structure 4 in a plane which extends substantially perpendicularly with respect to the longitudinal central axis or direction indicated by the double-headed arrow 6.

Figure 1:
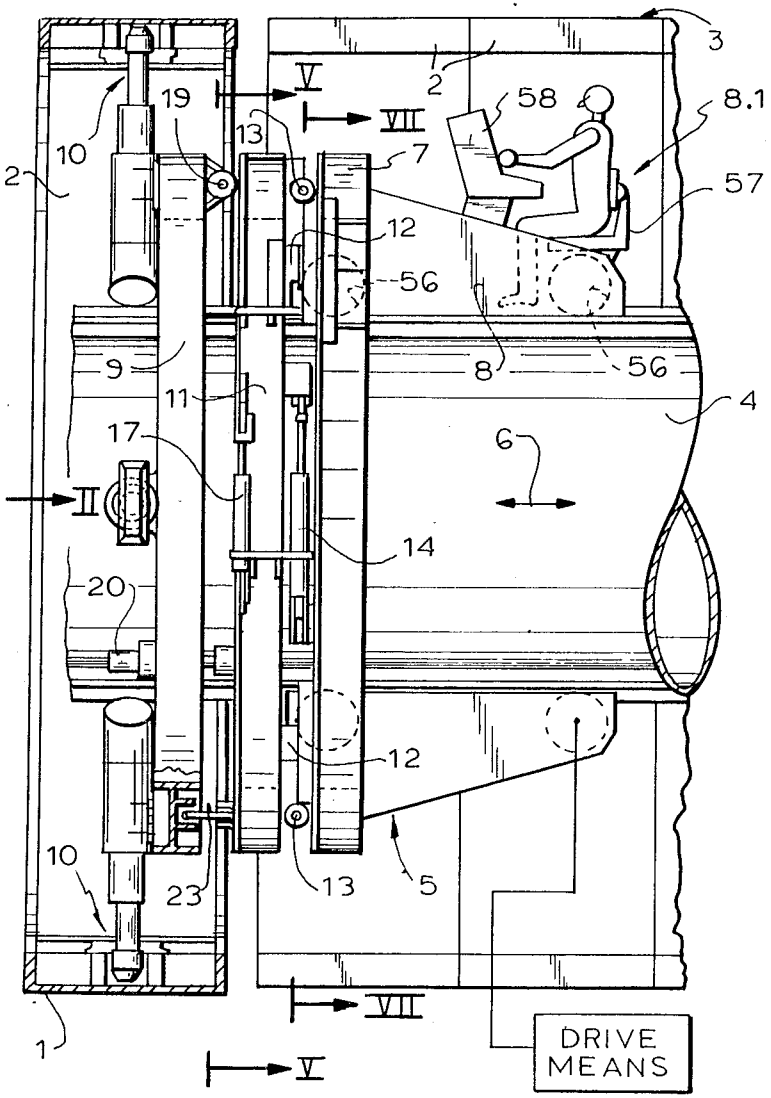
FIG. 1 is a side elevation of the apparatus in accordance with one embodiment of the invention.
Figure 7:
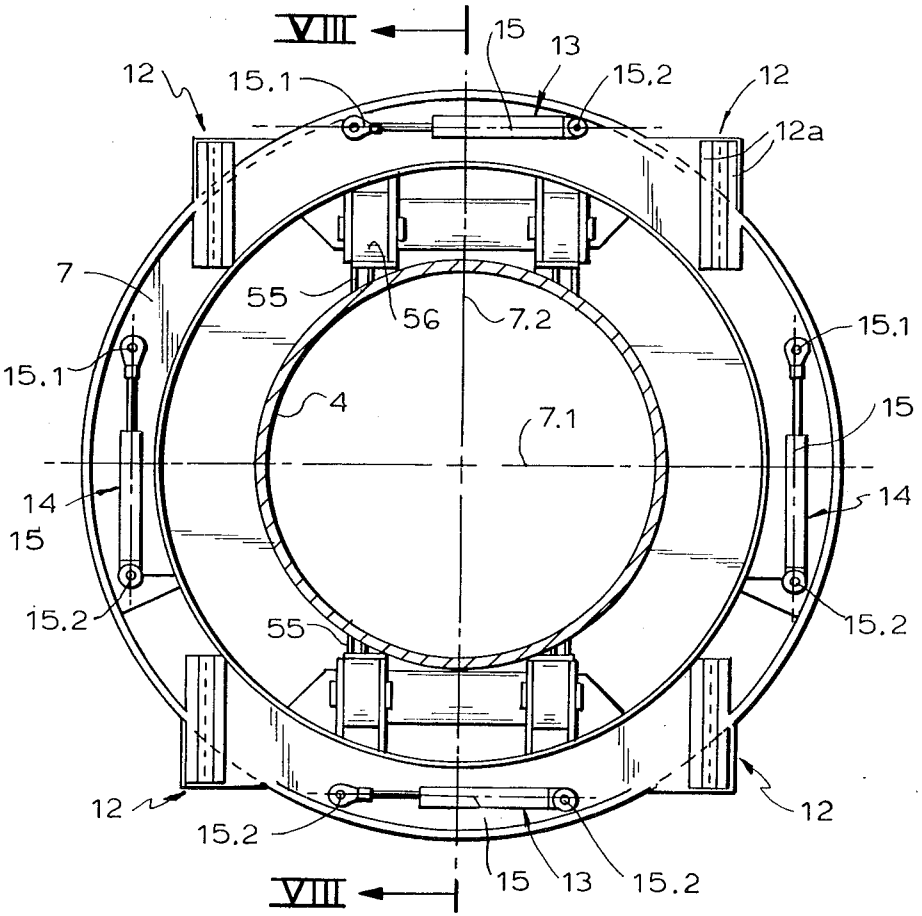
FIG. 7 is a cross section along line VII—VII in FIG. 1 showing further details of the carriage support ring and the associated piston-cylinder assemblies.

As is also apparent from FIGS. 1 and 7 the tube 4, which can have a debris conveyor, not shown, extending therethrough, is formed with rails 55 upon which the wheels or rollers 56 of the carriage 5 and ring 7 can ride. An operator's seat 57 is likewise provided on the carriage and is juxtaposed to a control panel 58 within reach of the operator and which serves to control not only the drive 8.2 of the carriage, but all of the piston cylinder units and manipulators to be described.

A segment support ring 9 is arranged in a prepositive manner and generally parallel with respect to the carriage support ring 7, whereby the carriage support ring 7 (carries or supports) is connected to the segment support ring 9 as will become apparent as the description proceeds.

Radially disposed and acting adjustment manipulator assemblies 10 for the casing segments 1 of a respective casing ring 2 are mounted on the segment support ring 9. The purpose and operation of the manipulator assemblies will be described further below with reference to FIG. 2.

Referring again to FIG. 11 it will be apparent that the carriage 5 can be moved in the longitudinal direction represented by arrow 50 and that the ring 11 can be displaced relative to ring 7 in two mutually perpendicular directions (arrows 51) in a plane perpendicular to the axis of the tube 4, that the ring 16 within ring 11 can be moved angularly relative to ring 11 as represented by arrow 52, that the ring 9 can be tilted relative to the ring 16 as represented by arrow 53 and that the segments can be displaced radially relative to the ring 9 as represented by arrows 54.

The support ring 11, hereinafter also referred to as first intermediate support ring is mounted between the carriage support ring 7 and the segment support ring 9.

This first intermediate support ring 11 is generally disposed in a plane which extends perpendicularly with respect to the longitudinal central axis (arrow) 6 of the support bridge structure 4. The support ring 11 is connected or joined to the carriage support ring 7 by means of two pairs of cross guide assemblies 12, the arrangement of which is most clearly indicated in FIG. 7. In general terms a cross guide assembly is comprised of two parallel guide bars at the forward face of the carriage support ring 7 which are adapted to receive and guide between them a single guide bar at the rearward face of the intermediate support ring 11, thereby defining the two mutually perpendicular directions of movement in a plane perpendicular to the axis of tube 4 with which ring 11 can move relative to the ring 7.

The support ring 11 is also connected or joined to the carriage support ring 7 by means of two pairs of control piston-cylinder assemblies 13 and 14, the arrangement of which is also most clearly indicated in FIG. 7 to effect the last-mentioned displacements.

The pairs of piston-cylinder assemblies 13 and 14 extend generally perpendicularly to one another. Within each pair, the piston-cylinder assemblies 13 and 14 are arranged in such a way so as to extend parallel with respect to one another. The piston-cylinder assemblies 13 and 14 are also positioned in a plane which is substantially parallel with respect to the major plane of the carriage support ring 7. Accordingly, as shown in FIG. 7, the four piston-cylinder assemblies are symmetrically spaced in circumferential direction, while extending generally perpendicularly with their respective longitudinal axis 15 relative to a respective axis of the carriage support ring 7, i.e. the horizontal axis 7.1 for the assemblies 13, and the vertical axis 7.2 for the assemblies 14.

Furthermore, the exterior piston ends 15.1 of the assemblies are connected to the first intermediate support ring 11, on the one hand, whereas the cylinder ends 15.2 of the assemblies are secured, on the other hand, at the carriage support ring 7. The respective connections can include standard clevises or similar means which are known in the art.

The first intermediate support ring 11 can be shifted by way of the control piston-cylinder assemblies 13 and 14 relative to the carriage support ring 7 in its place about two directions which extend substantially perpendicularly with respect to one another.

Figure 8:
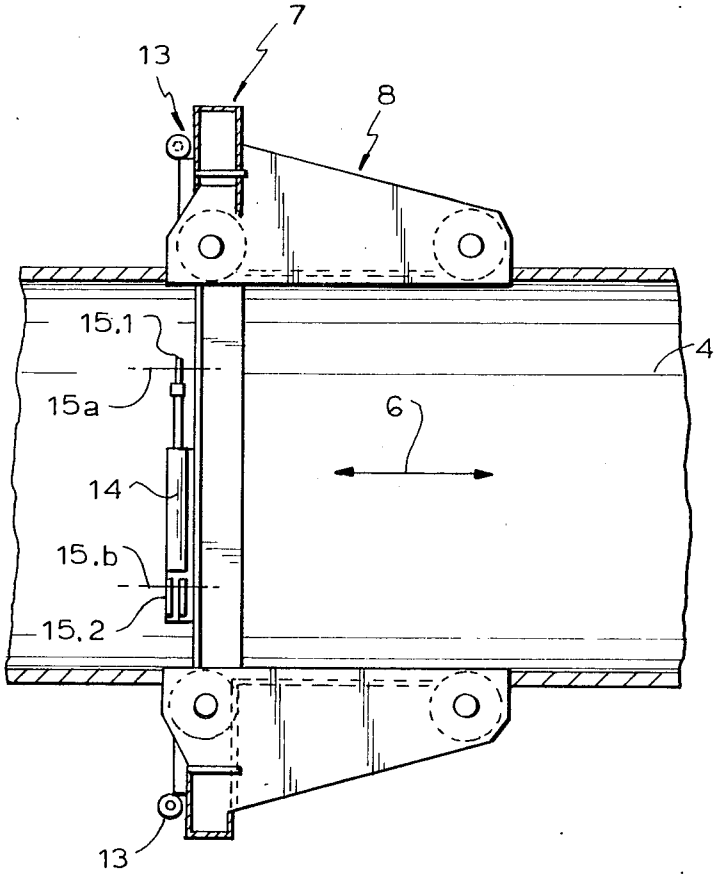
FIG. 8 is a cross section along line VIII—VIII in FIG. 7 showing in side elevation details of the features shown in FIG. 7.

In other words, the piston-cylinder assemblies 13 and 14 of each pair are arranged horizontally, and vertically respectively, and they are linked to the carriage support ring 7, as well as the first intermediate support ring 11. They are respectively connected to allow swinging or pivoting movements about the axes 15*a* and 15*b*. The respective axes 15*a* and 15*b* extend parallel with respect to the longitudinal central axis (arrow) 6 of the support bridge structure 4 as is shown in FIG. 8.

The second intermediate support ring, also referred to as intermediate ring 16 hereinafter, is kinematically arranged between the first intermediate support ring 11 and the segment support ring 9 as is described in greater detail below. More specifically, this intermediate ring 16 extends concentrically in the first intermediate support ring 11 and parallel, respectively, to the major plane of the first intermediate support ring 11. The intermediate ring 16 is arranged on the forward or face side of the first intermediate support ring 11, which is directed towards the segment support ring 9, and it is journaled or mounted in the first intermediate support ring 11 so that it can turn or rotate relative thereto.

The second intermediate support ring 16 can also be swung or moved with respect to the first intermediate support ring 11 (compare FIGS. 5 and 6) and can be swung about an axis which extends substantially parallel to the longitudinal direction (arrow 6). The movement is effected by means of a swing actuating piston-cylinder assembly 17 which extends vertically when viewed in FIG. 5.

Each assembly 17 includes two piston-cylinder assemblies which are arranged in a plane which is parallel with respect to that of the carriage support ring 7. However, they do not extend in a radial manner, but the longitudinal axis 17.1 (FIG. 5) of each extends perpendicularly with respect to the longitudinal axis (arrow 6) of the support bridge structure 4. The piston ends 18.2 are connected to the second intermediate support ring 16 and the cylinder ends 18.1 are secured to the first intermediate support ring 11.

The swing piston-cylinder assemblies 17, accordingly, are positioned vertically and they are pivotally attached so that they can be swung about the axes 18*a* and 18*b*, as indicated in FIG. 6. The axes 18*a* and 18*b*, when viewed in FIG. 6 are generally parallel with respect to the longitudinal axis (arrow 6) of the support bridge structure 4.

Figure 10:
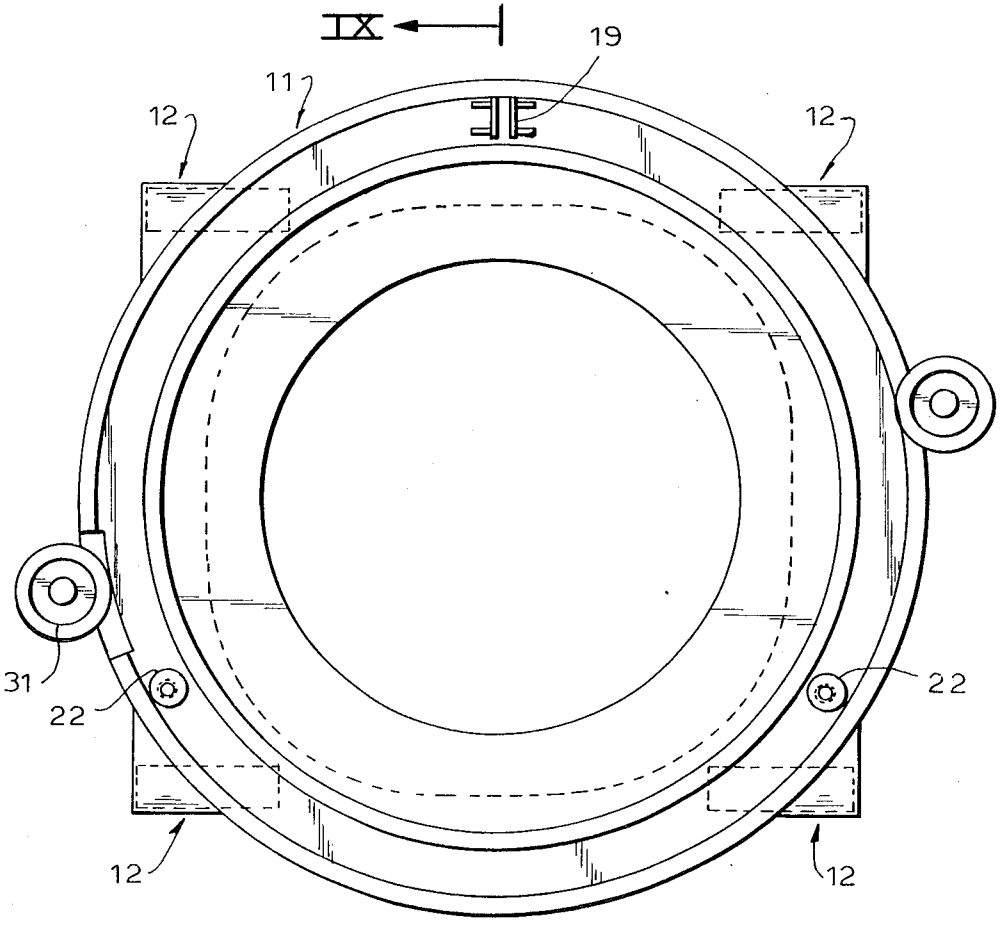
FIG. 10 is an end view of the assembly of FIG. 9, similar to the view shown in FIG. 5.
Figure 9:
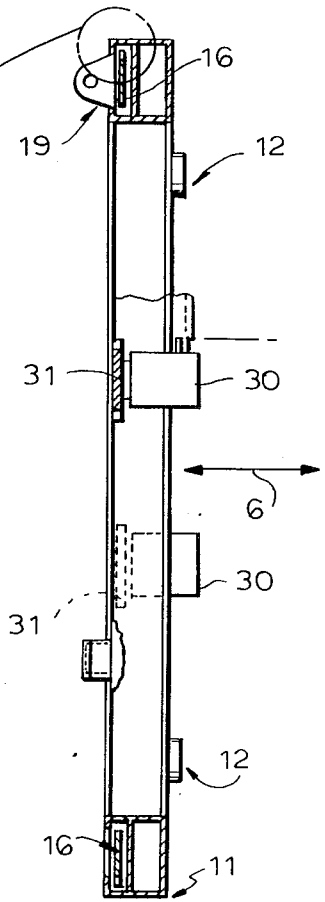
FIG. 9 is a cross section along line IX—IX in FIG. 10 showing details of two alternate intermediate support rings.
Figure 9A:
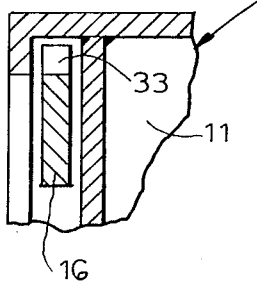
FIG. 9A is a detail of the peripheral arrangement of the two intermediate support rings, within the circle in FIG. 10.

The swing range or range of arcuate movement may be extended to include 360° when use is made of motors, instead of the piston-cylinder assemblies 17. The motors are generally indicated by reference numeral 30 in FIG. 10. Each motor 30 carries on its output shaft a pinion 31 which engages with cooperatingly arranged external gear teeth 33 on the outer perimeter of the ring 16 (FIG. 9A).

The position or attitude of the segment support ring 9 with the radial adjustment manipulator assemblies 10 is generally determined from or by the fixed point 19, and the segment support ring 9 is suspended at the point 19 from the intermediate ring 16 (see FIG. 1). The point 19 can be provided by a clevis or similar linkage means which allows a spatial linkage (space hinge) and/or movement of the segment support ring 9.

Figure 3:
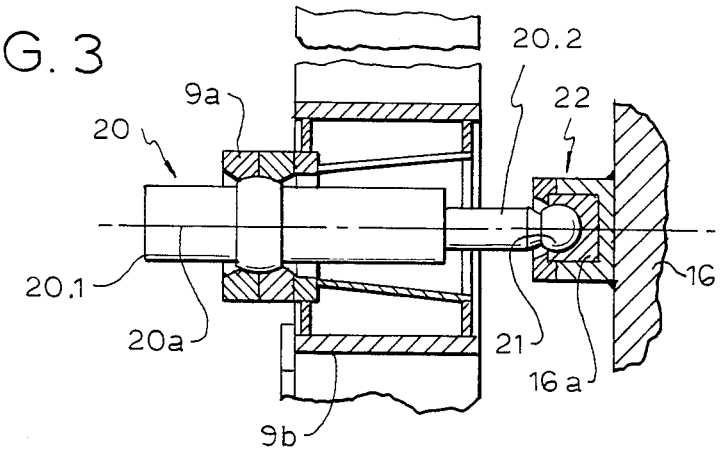
FIG. 3 is a cross section through the segment support ring along line III—III in FIG. 2.

Two pendulum supports 20 provided by hydraulic piston-cylinder assemblies are also arranged beneath the fixed point 19. These assemblies extend parallel with their longitudinal axes 20*a* (FIG. 3) relative to the longitudinal axis (arrow 6) of the support bridge structure 4 (FIG. 1). As is shown in greater detail in FIG. 3, the pendulum supports 20 connect the segment support ring 9 and the intermediate support ring 16 in a multi-dimensional-linkage manner (space hinge) or in the manner of a ball-and-socket joint as generally depicted at 22.

Accordingly, the respective cylinder 20.1 is mounted in a sleeve 9*a* which is secured at the forward side of the segment support ring 9 by way of a hollow cylindrical support structure 9*b*. The sleeve 9*a* allows pivotal movements of an assembly 20. The piston 20.2 of a pendulum support 20 is, in turn, equipped with a spherical formation 21 which is secured in the respectve socket formation 16*a* secured at the forward side or face of the intermediate support ring 16. As is indicated in FIG. 2, the pendulum supports 20 are located at the respective corners of an equilateral triangle.

The two pendulum support assemblies 20 serve to incline the segment support ring 9 relative to the second ring 16 or the carriage support ring 7, respectively, in two directions which are perpendicular to one another. The respective inclination plane extends initially perpendicularly with respect to the longitudinal direction of arrow 6 of the support bridge structure 4. These directions define a plane perpendicular to the axis of the tube 4.

As is indicated in FIG. 2, the segment support ring 9 is also connected to the second ring 16 by way of a rigid torque support or take-up assembly 23. This connection is done on the side which is diametrically across from the fixed point 19, i.e. beneath the pendulum supports 20. The torque support assembly 23 serves to stabilize the segment support ring 9 in the event of eccentrically directed forces or loads, perpendicularly to the longitudinal axis (arrow) 6 vis-a-vis the fixed point 19. Such eccentrically directed loading can arise as a consequence of imbalances arising from casing segments 1 being mounted unevenly on the segment support ring 9, or due to tensile forces arising when releasing the casing segments 1 from solidifying concrete.

The torque or torsion support or take-up assembly 23 is comprised of a longitudinal push/pull rod 23*a*. In its starting position the rod 23*a* is aligned in parallel with its longitudinal axis with respect to the equilateral side 24 which is obtained by the line passing through the respective centers of the two pendulum supports 20 (see FIG. 2).

The end 25*a* of rod 23*a* is linked at the segment support ring 9 for example by a clevis-type connection 9*c*. The other end 25*b*, in turn, is linked to the intermediate support ring 16 by a clevis-type connection 16*a*.

Figure 4:
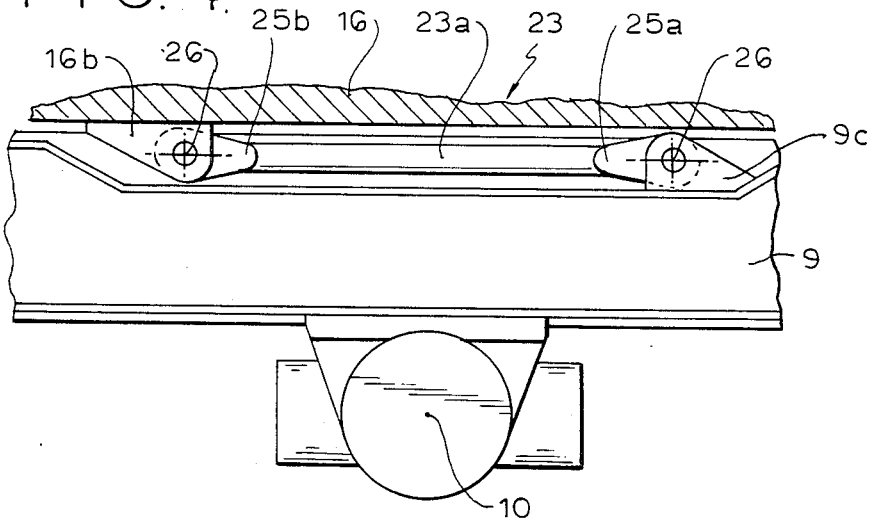
FIG. 4 is a cross section through the segment support ring at a rigid torque support along line IV—IV in FIG. 2.

The respective axes of rotation 26, or pivot centers, extend parallel with respect to one another (FIG. 4). As is suggested in FIG. 2 they can be said to extend perpendicularly to the longitudinal axis (arrow) 6 of the support bridge structure 4 and with respect to line 24 passing through the respective centers or axes 26 of the two pendulum supports 20. The ends 25*a* and 25*b* allow pivotal or similar movement of the rod 23*a* occasioned by respective movements of the segment support ring 9 and the intermediate support ring 16. The respective movements are diagramatically indicated in FIGS. 3 and 4. Thus, the lower portion of intermediate support ring 16 is positioned at a distance from the segment support ring 9. This distance can be traversed by the ring 16 until the forward end of the socket formation 16*a* slightly enters into the end of the support structure 9*b* (broken lines in FIG. 3). The distance of travel will be determined by the stroke of the pistons 20.2 and the fixed point 19 acts as the main pivot center for the movement with two degrees of freedom.

As is clear from the drawing, the segment support ring 9 can remove or relocate respective casing segments 1 from the rearward end of the inner casing 3, i.e. the respective last casing ring 2. These can be taken up in any desired position or location. The casing segments 1 can then be shifted or moved by means of the transport carriage 5 to the respective forward position (FIG. 11), and a respective ring 2 can be set again in place at the respective forward end of the inner casing 3 in practically any desired position or location.

Thus, as is indicated in some detail in FIG. 2, the radial manipulator assemblies 10 can be extended and retracted whereby their forward or free ends engage in recesses in the individual casing segments 1. FIG. 2 shows several manipulator assemblies in the extended position. The manipulator assembly 10 on the horizontal axis at 3:00 o'clock is shown in the intermediate retracted position, whereas the manipulator assembly 10 at 9:00 o'clock is shown in the fully retracted position. The fully extended position of the manipulator assemblies places the segments 1 in the circle pattern of the inner casing 3 and the retracted position of the manipulator assemblies temporarily dismantles the circular pattern of the inner casing 3.

The to and fro movement of the transport carriage allows transfer of the segments 1 from one ring forming position to another. Any strains or necessary movements are fully absorbed by the various described means, i.e. pivots and universal-joint type connections described herein.

The intermediate ring 16 and the segment support ring 9 connected to it can be rotated for the assembly and disassembly of the inner casing 3. As well, as mentioned, certain adjustment or control movements can be carried out by the apparatus because the support ring 9 and the intermediate ring 16 are adjustable with respect to one another.

In summary, the ring 11, and the ring 9 connected to it, can be moved to and fro with respect to the carriage support ring 7. The intermediate support ring can carry out rotating movements within the ring 11 and with respect to the longitudinal axis 6, whereby the ring 9 will carry out the same rotating movements by virtue of its connection to the ring 16. In addition, the lower end of ring 9 can be pivoted away from the ring 16 by being hingedly or similarly connected at 19 to the ring 16.

I claim:

1. An apparatus for moving casing rings of an interior casing for tunnels, shafts and the like structures in excavating, mining, construction, and the like operations, from a first location to a second location, whereby a casing ring is made of several individual casing segments and the casing rings, when positioned alongside each other, form a respective inner casing, especially apparatus which is intended for the lining of tunnels with concrete, said apparatus comprising:

a tubular support bridge structure which can be disposed generally centrally within a casing to be formed in a tunnel;

a transport carriage guided on said support bridge structure, and movable longitudinally along said support bridge structure;

a carriage support ring operatively connected to said transport carriage, said carriage support ring concentrically surrounding said support bridge structure, said carriage support ring lying in a plane substantially perpendicular to a longitudinal central axis of said support bridge structure;

a segment support ring parallel to and disposed ahead of said carriage support ring and connected thereto for cooperation therewith;

a plurality of radially disposed and radially acting adjustment manipulator assemblies mounted on said segment support ring for shifting respective casing segments of a respective casing ring;

a first support ring mounted between said carriage support ring and said segment support ring, said first support ring lying in a plane perpendicular with respect to said longitudinal axis;

means for connecting said first support ring to said carriage support ring, said means including at least a cross guide assembly, and a piston-cylinder assembly for displacing said first support ring on said carriage support ring in two mutually perpendicular directions in a plane perpendicular to said axis;

a second support ring between said first support ring and said segment support ring and provided with means for angularly displacing said second support ring relative to said first support ring about a respective axis of rotation; and means for connecting said segment support ring to said second support ring, said means including a device for providing a fixed point, and two pendulum piston-cylinder assemblies which are equidistantly spaced from one another and from said fixed point, said pendulum piston-cylinder assemblies serving to tilt said segment support ring relative to said second ring.

2. The apparatus according to claim 1 wherein said means for angularly displacing said second support ring includes at least one pair of piston-cylinder assemblies for swinging said second support ring relative to said first support ring about an axis of rotation which extends at least substantially parallel to said longitudinal central axis.

3. The apparatus according to claim 1 wherein said second support ring is formed with peripheral gear teeth, and wherein said means for displacing said second intermediate support ring includes at least one motor mounted on said first intermediate ring, and a pinion driven by said motor and meshing with said teeth for rotating said second intermediate support ring.

4. The apparatus according to claim 1 wherein said second support ring can be rotated through an arc of 360° with respect to said first intermediate support ring.

5. The apparatus according to claim 1 wherein said segment support ring is additionally connected to said second support ring on a side diametrically across from said fixed point by way of a rigid torque support including at least one rod having an articular linkage at each end.

6. The apparatus according to claim 1 wherein said device for providing a fixed point includes at least one clevis assembly.

7. In an apparatus for removing and resetting casing rings (2) of an interior casing (3) in a tunnel for lining by placed concrete, the apparatus including a tubular support bridge structure (4) which extends generally centrally within the casing (3);

a transport carriage (5) which is guided at and on the support bridge structure (4), and which can be moved longitudinally with respect to the support bridge structure;

a carriage support ring (7) which carries the supporting framework and undercarriage (8) of an operator station and associated drive means, the carriage support ring concentrically surrounding the support bridge structure (4) in a plane which extends substantially perpendicularly with respect to a longitudinal central axis of the support bridge structure; and a segment support ring (9) which is arranged in prepositive manner and parallel with respect to the carriage support ring (7) and cooperatingly connected thereto;

radially disposed and acting adjustment manipulator assemblies (10) on said segment support ring for casing segments (1) of a casing ring (2);

a first intermediate support ring (11) mounted between the carriage support ring (7) and the segment support ring (9) and extending generally in a plane perpendicular to said axis, said first intermediate support ring (11) being connected to the carriage support ring via:

(a) cross guide assemblies (12) and (b) two mutually perpendicular pairs of control piston-cylinder assemblies (13,14) which are arranged in such a way so as to extend parallel with respect to one another and in a plane which is substantially parallel to said carriage support ring (7), arranged in circumferentially spaced relation, and respectively linked to said first intermediate support ring (11) and to said carriage support ring (7), whereby said first intermediate support ring (11) can be shifted with respect to the carriage support ring (7) with the aid of the control piston-cylinder assemblies (13,14) in its plane and in two directions which extend substantially perpendicularly with respect to one another;

a second intermediate support ring (16) arranged concentrically with respect to and journaled for rotation in the first intermediate support ring (11), and means for inclining the segment support ring (9) with respect to the carriage support ring (7) and in two directions which are perpendicular to one another and in a plane which extends substantially perpendicular to said axis, the improvement wherein:

the segment support ring (9) is connected by a space hinge at a fixed point (19) to said second intermediate support ring (16) and two pendulum piston-cylinder assemblies (20) are provided to form said means for inclining said segment support ring, said pendulum assemblies being spaced from one another and from the fixed point (19) by the same distance, said pendulum piston-cylinder (20) being connected to said second intermediate support ring (16).

8. The improvement defined in claim 7 wherein the segment support ring (9), on a side which is diametrically across from the fixed point (19), is additionally connected, via a rigid torque support (23) with a journal (25) having n articular linkage at each end, to the second intermediate support ring (16).

9. The improvement defined in claim 7 wherein the second intermediate support ring (16) is mounted and arranged to rotate through an arc of 360° with respect to the first intermediate support ring (11).

* * * * *